United States Patent [19]

Fehler et al.

[11] 4,431,386

[45] Feb. 14, 1984

[54] CONCRETE-PUMP ASSEMBLY

[75] Inventors: Jürgen O. Fehler, Waldbronn; Rolf Griesbach, Dortmund, both of Fed. Rep. of Germany

[73] Assignee: Elba-Werk Maschinen-Gesellschaft mbH & Co., Ettlingen, Fed. Rep. of Germany

[21] Appl. No.: 326,893

[22] Filed: Dec. 2, 1981

[30] Foreign Application Priority Data

Dec. 5, 1980 [DE] Fed. Rep. of Germany ..... 3045885
May 13, 1981 [DE] Fed. Rep. of Germany ..... 3118937

[51] Int. Cl.[3] ..... F04B 15/02

[52] U.S. Cl. ..... 417/517; 417/532; 417/900

[58] Field of Search ..... 417/516, 517, 518, 519, 417/532, 900

[56] References Cited

U.S. PATENT DOCUMENTS 3,832,097 8/1974 Schlect ..... 417/900 X
3,989,420 11/1976 Taylor ..... 417/517
4,178,142 12/1979 Schwing ..... 417/900 X

*Primary Examiner*—Richard E. Gluck
*Assistant Examiner*—Peter M. Cuomo
*Attorney, Agent, or Firm*—Karl F. Ross; Herbert Dubno

[57] ABSTRACT

A pump assembly for concrete comprises a hopper adapted to hold the mass and having a front wall formed with a front port centered on a front axis perpendicular to the front wall at the front port and a rear wall formed with two rear ports centered on respective rear axes perpendicular to the rear wall at the rear ports and generally parallel to the front axis. Respective piston pumps secured to the rear wall outside the hopper over the rear ports can draw portions of the mass out of the hopper and expel the drawn-out portions back into the hopper through the respective rear ports. An outlet conduit is connected to the front wall outside the hopper over the front port. A generally curved or non-straight distributor pipe in the hopper has a front end engaged over and aligned with the front port, a rear end engageable over and alignable with either of the rear ports, and a generally arcuate centerline crossing the front axis at the front port and extending parallel to the rear axes at the rear wall. The distributor pipe can be pivoted about the front axis between a position with the rear end aligned with and engaged over one of the rear ports and the other rear port exposed in the hopper and another position with the rear end aligned with and engaged over the other rear port and the one rear port exposed in the hopper. The pipe can be wholly curved between its front and rear ends, with the centerline smoothly arcuate, or it can be formed of two straight portions joined at an elbow.

10 Claims, 4 Drawing Figures

Fig. 2
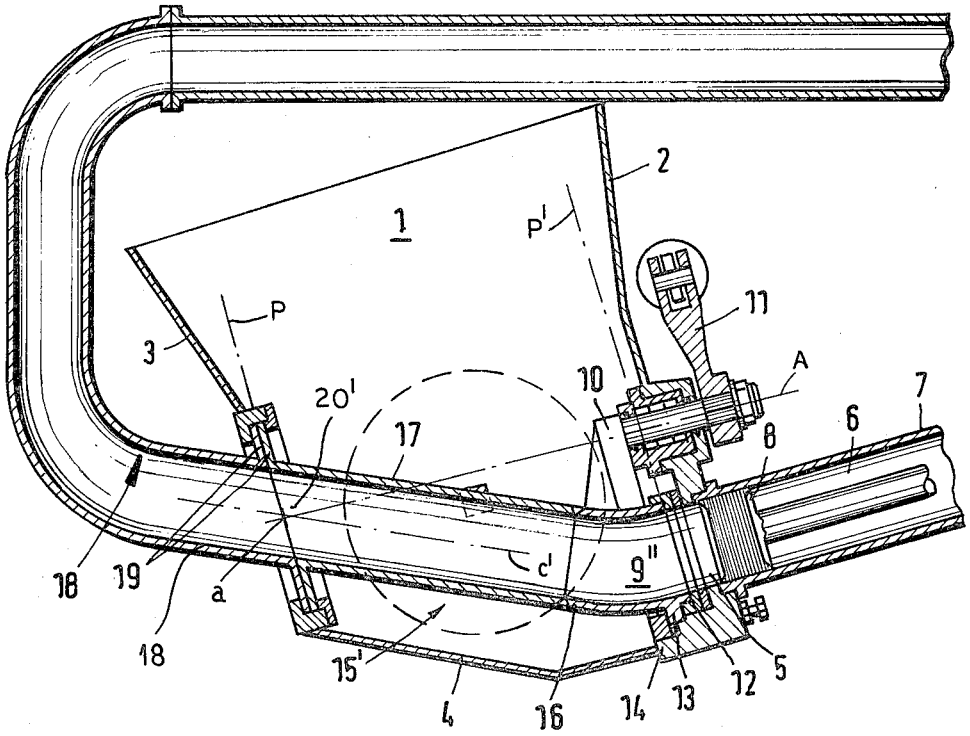
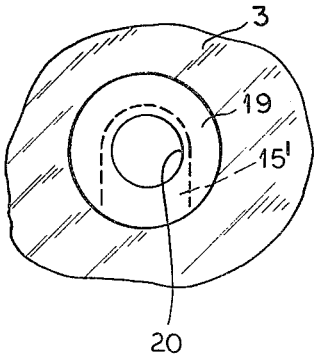
Fig. 4

CONCRETE-PUMP ASSEMBLY

FIELD OF THE INVENTION

The present invention relates to a pump assembly for concrete-like masses. More particularly this invention concerns a concrete-pump assembly.

BACKGROUND OF THE INVENTION

A pump assembly for concrete-like masses is known which has a hopper adapted to hold the mass and having a front wall formed with a front port and a rear wall formed with two rear ports. Respective piston pumps secured to the rear wall outside the hopper over the rear ports can draw portions of the mass out of the hopper and expel the drawn-out portions back into the hopper through the respective rear ports. An outlet conduit is connected to the front wall outside the hopper over the front port. A nonstraight distributor pipe in the hopper has a front end engaged over and aligned with the front port, and a rear end engageable over and alignable with either of the rear ports. Such an assembly has means for pivoting the distributor pipe about the front axis between a position with the rear end aligned with and engaged over one of the rear ports and the other rear port exposed in the hopper and another position with the rear end aligned with and engaged over the other rear port and the one rear port exposed in the hopper. Thus this distributor pipe oscillates back and forth synchronously with the pumps to deliver a nearly continuous flow to the outlet conduit. As one pump is expelling its contents into the distributor pump, the other pump is sucking in a new load directly from the hopper, then the distributor pipe swings over and the pumps reverse.

German Pat. No. 1,285,319 and German patent document 1,653,607 describe such a system. The distributor pipe in these arrangements is S-shaped, so that extensions from the front and rear ends of the centerline of the pipe are parallel but laterally offset from each other. This double bend in the distributor pipe leads, obviously, to greater resistance to flow. Hence the head of such a pump assembly is limited. Otherwise the pumps have to be overdimensioned to overcome this nonproductive deflection of flow.

Such a pump is also disadvantageous when permanently mounted on a concrete-pumper truck. Normally the pump assembly is mounted on the chassis and the concrete is pumped into a pipe that extends centrally out from a distributor post. Substantial piping is necessary for the pump assembly to be hooked up in such an arrangement. Obviously conducting the concrete unnecessarily through such piping represents a serious waste of energy.

OBJECTS OF THE INVENTION

It is therefore an object of the present invention to provide an improved pump assembly for concrete-like masses.

Another object is the provision of such a pump assembly for concrete-like masses which overcomes the above-given disadvantages.

A further object is to provide such a pump assembly which offers minimum resistance to flow and wherein the path through it is as short as possible.

SUMMARY OF THE INVENTION

These objects are attained according to the instant invention in a pump assembly for concrete-like masses, which comprises a hopper adapted to hold the mass and having a front wall formed with a front port centered on a front axis perpendicular to the front wall at the front port and a rear wall formed with two rear ports centered on respective rear axes perpendicular to the rear wall at the rear ports and generally parallel to the front axis. Means including respective pistons and cylinders secured to the rear wall outside the hopper over the rear ports can draw portions of the mass out of the hopper and expel the drawn-out portions back into the hopper through the respective rear ports. An outlet conduit is connected to the front wall outside the hopper over the front port. According to this invention a generally curved or nonstraight distributor pipe in the hopper has a front end engaged over and aligned with the front port, a rear end engageable over and alignable with either of the rear ports, and a generally arcuate centerline crossing the front axis at the front port and extending parallel to the rear axes at the rear wall. Means is provided for pivoting the distributor pipe about the front axis between a position with the rear end aligned with and engaged over one of the rear ports and the other rear port exposed in the hopper and another position with the rear end aligned with and engaged over the other rear port and the one rear port exposed in the hopper. According to this invention the distributor pipe is wholly curved between its front and rear ends, the centerline being smoothly arcuate. It is also possible in accordance with the invention for the distributor pipes to have a straight front end portion extending at an angle to the axes, a straight rear end portion extending parallel to the axes, and an elbow joining the end portions. In this case it is normal when the front end portion is substantially longer than the rear end portion.

The system according to this invention therefore has a very short path through the pump assembly. The mass enters and leaves the distributor pump in a straight line, and is only slightly deflected through one bend in the deflector pipe. In addition, due to the fact that the front end of the distributor pipe meets the front wall at an angle, the outlet conduit need not make a large loop to go up and back in the opposite direction, but can start out inclined upwardly right at the front wall.

In accordance with another feature of the invention the pipe opens at its front end at a substantially circular mouth lying in a plane perpendicular to the axes and inclined to the centerline where same crosses the front axis. The pipe is of elliptical section adjacent the mouth. In addition the outlet conduit opens at the front port at a substantially circular mouth lying in a plane perpendicular to the axes and centered on an extension from the front end of the centerline. The mouths are aligned and juxtaposed and the outlet conduit is of elliptical section adjacent its mouth.

To ease maintenance and further reduce the size of the assembly according to this invention the seal between the front end and the front wall around the front port lies inside the hopper.

According to another feature of the invention the front end abuts the front wall at a plane perpendicular to the axes. The inventive assembly further has a guide on the rear wall in which the rear end slides on movement of the pipe between its end positions.

DESCRIPTION OF THE DRAWING

The above and other features and advantages will become more readily apparent from the following, reference being made to the accompanying drawing in which:

FIG. 2 is a section similar to FIG. 1 through another assembly according to the invention; and FIGS. 3 and 4 are sections taken respectively along lines III—III and IV—IV of FIG. 1.

SPECTIFIC DESCRIPTION

Figure 1:
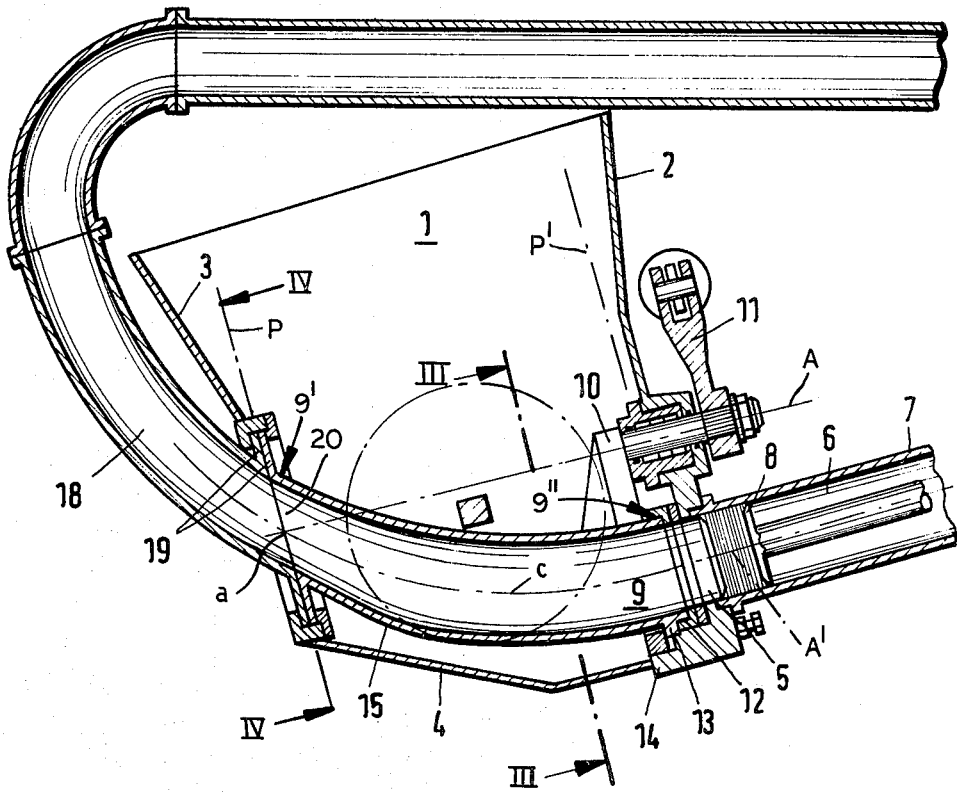
FIG. 1 is a side sectional view through an assembly according to the instant invention.
Figure 3:
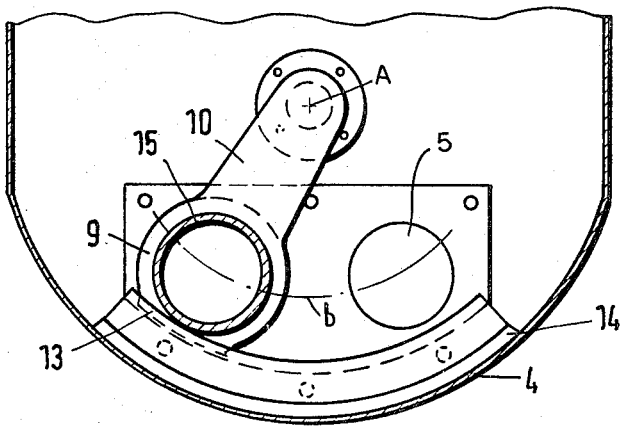

A pump assembly has a hopper 1 with a rear wall 2, a front wall 3 spaced from it, and a floor 4 as seen in FIGS. 1 and 2. The rear wall 2 is formed adjacent the floor 4 with a pair of horizontally spaced circular rear ports 5 centered on respective axes A' and that each open into a respective unit 6 of the type having a cylinder 7 and a reciprocal piston 8. These units 6 are operated alternately in the manner described in more detailed in commonly owned application 290,695 filed Aug. 6, 1981 by R. Griesbach so that as one unit 6 is sucking in concrete from the hopper 1, the other unit 6 is expelling a sucked-in portion back into the hopper 1 through the respective port 5.

Inside the hopper 1 there is a distributor 9 carried on an arm 10 that can be pivoted by a cylinder 11 about an axis A that extends at point a through the center of a front port 20 formed in the front wall 3, but above the axes or centers of the ports 5. This distributor 9 comprises an arcuate pipe 15 that has a front end 9' opening at the front port 20 and a rear end 9'' that can be swung through an arc b centered on the axis A to align with either of the ports 5 in respective end positions of the distributor 9.

To this end the rear wall 2 is provided with a guide plate 14 formed with the ports 5. The rear end 9'' carries a shoe 12 that rides flatly on this plate 14, and is formed with a flange or ridge 13 that engages in a groove of the plate 14 to hold the end 9'' tightly in place against the end wall 2.

The end 9' is formed with a circular flange 19 matching with another identical such flange 19 formed on an outlet conduit 18 that also opens at a mouth centered on the point a. As seen in FIG. 4 the mouth 20 is of circular shape. The pipe 15 and conduit 18 are of elliptical section immediately adjacent the mouth 20, so that when cut off obliquely as illustrated they will form such circular mouths that are centered on the point a and that will stay perfectly aligned as the distributor 9 is oscillated between its end positions.

The pipe 15 has a smoothly curved centerline c that extends at an angle to a plane P perpendicular to the axis A at the mouth 20 and perpendicular to a plane P' perpendicular to the axes A' of the mouths 5 at the mouths 5. This centerline c intersects the axis A at a inside the mouth 20. Thus smooth, virtually laminar flow will take place through the pipe 15, but the concrete will exit from the distributor 9 going up, so that the outline conduit 18 can extend up and over the hopper 1 relatively easily, making it ideal for use on a concrete-pumper truck.

FIG. 2 shows an arrangement wherein the distributor 9 has a pipe 15' whose end 9' is short and straight and joined at an elbow 16 with a long straight portion 17 whose centerline c' is perfectly straight. The outlet conduit 18 is not curved adjacent the wall 3, but has a straight portion 18' connected to the wall 3 at the mouth 20'. Otherwise this arrangement is identical to that of FIG. 1. Its chief advantage is that the pipe 15' is cheaper to manufacture. In addition flow is particularly smooth through the wall 3 for minimal wear at the front port.

Either of the systems of the instant invention offers substantially less resistance to flow through the distributor 9 than any prior-art machine. Due to the extreme viscosity and abrasiveness of concrete, this represents a considerable saving in pumping energy.

We claim:

1. A pump assembly for concrete-like masses, said assembly comprising:

a hopper adapted to hold said mass and having a front wall formed with a front port centered on a front axis perpendicular to said front wall at said front port and a rear wall formed with two rear ports centered on respective rear axes perpendicular to said rear wall at said rear ports and generally parallel to said front axis;

means including respective piston and cylinder units secured to said rear wall outside said hopper over said rear ports for drawing portions of said mass out of said hopper and expelling the drawn-out portions back into said hopper through the respective rear ports;

an outlet conduit connected to said front wall outside said hopper over said front port;

a nonstraight distributor pipe in said hopper having a front end engaged over and aligned with said front port, a rear end engageable over and alignable with either of said rear ports, and a nonstraight centerline crossing said front axis at said front port and extending parallel to said rear axes at said rear wall; and means for pivoting said distributor pipe about said front axis between a position with said rear end aligned with and engaged over one of said rear ports and the other rear port exposed in said hopper and another position with said rear end aligned with and engaged over said other rear port and said one rear port exposed in said hopper.

2. The pump assembly defined in claim 1 wherein said distributor pipe is wholly curved between its front and rear ends, said centerline being smoothly arcuate.

3. The pump assembly defined in claim 1 wherein said distributor pipe has a straight front end portion extending at an angle to said axes, a straight rear end portion extending parallel to said axes, and an elbow joining said end portions.

4. The pump assembly defined in claim 3 wherein said front end portion is substantially longer than said rear end portion.

5. The pump assembly defined in claim 1 wherein said pipe opens at its said front end at a substantially circular mouth lying in a plane perpendicular to said axes and inclined to said centerline where same crosses said front axis, said pipe being of elliptical section adjacent said mouth.

6. The pump assembly defined in claim 5 wherein said outlet conduit opens at said front port at a substantially circular mouth lying in a plane perpendicular to said axes and centered on an extension from said front end of said centerline, said mouths being aligned and juxtaposed, said outlet conduit being of elliptical section adjacent its said mouth.

7. The pump assembly defined in claim 1, further comprising a seal between said front end and said front wall around said front port, said seal lying inside said hopper.

8. The pump assembly defined in claim 1 wherein said front end abuts said front wall at a plane perpendicular to said axes.

9. The pump assembly defined in claim 1, further comprising a guide on said rear wall, said rear end sliding on said guide on movement of said pipe between its said positions.

10. The pump assembly defined in claim 1 wherein said outlet pipe extends up and over said hopper from said front wall.

* * * * *

UNITED STATES PATENT AND TRADEMARK OFFICE

CERTIFICATE OF CORRECTION

PATENT NO. : 4,431,386

DATED : 14 February 1984

INVENTOR(S) : Jurgen Oskar FEHLER et al

It is certified that error appears in the above-identified patent and that said Letters Patent is hereby corrected as shown below:

On the title page

In the heading, left-hand column, item [75], please add the following name and residence to the list of inventors: -- Franz-Hubert GEUE, Sundern --. Also, change "both" to -- all --.

Signed and Sealed this

*Twenty-second* Day of *May 1984*

[SEAL]

*Attest:*

GERALD J. MOSSINGHOFF

*Attesting Officer*

*Commissioner of Patents and Trademarks*